US008797182B1

(12) United States Patent
Howe

(10) Patent No.: US 8,797,182 B1
(45) **Date of Patent: *Aug. 5, 2014**

(54) VEHICLE OPERATOR SIGNALING SYSTEM

(76) Inventor: Chad Howe, Lennox, SD (US)

( * ) Notice: Subject to any disclaimer, the term of this patent is extended or adjusted under 35 U.S.C. 154(b) by 71 days.

This patent is subject to a terminal disclaimer.

(21) Appl. No.: 13/438,005

(22) Filed: Apr. 3, 2012

Related U.S. Application Data

(63) Continuation-in-part of application No. 13/233,218, filed on Sep. 15, 2011.

(51) Int. Cl.
*G08G 1/16* (2006.01)

(52) U.S. Cl.
USPC ..... 340/903; 340/901; 340/902; 340/904; 340/539.1; 340/539.13

(58) Field of Classification Search
USPC ..... 340/901–904, 539.1–539.13
See application file for complete search history.

(56) References Cited

U.S. PATENT DOCUMENTS

| | | | | |
|---|---|---|---|---|
| 5,886,627 | A | 3/1999 | Brady | |
| 6,154,126 | A | 11/2000 | Beasley | |
| 6,272,073 | B1 | 8/2001 | Doucette | |
| 6,762,678 | B2 | 7/2004 | Arens | |
| 7,265,665 | B2 | 9/2007 | Bouchard | |
| 7,498,929 | B2 | 3/2009 | Pedrick | |
| 7,804,886 | B2 | 9/2010 | Silver | |
| 7,907,975 | B2 | 3/2011 | Sakamoto | |
| 2002/0109601 | A1* | 8/2002 | Arens | 340/573.1 |
| 2005/0137786 | A1 | 6/2005 | Breed | |
| 2005/0200487 | A1* | 9/2005 | O'Donnell et al. | 340/573.1 |
| 2006/0028349 | A1 | 2/2006 | Hsu | |
| 2006/0197658 | A1 | 9/2006 | Light | |
| 2007/0005609 | A1 | 1/2007 | Breed | |
| 2007/0063831 | A1 | 3/2007 | Perkins | |
| 2008/0015771 | A1 | 1/2008 | Breed | |
| 2009/0021371 | A1 | 1/2009 | Radin | |
| 2010/0271201 | A1 | 10/2010 | An-Tsun | |

* cited by examiner

*Primary Examiner* — Daryl Pope
(74) *Attorney, Agent, or Firm* — Jeffrey A. Proehl; Woods, Fuller, Shultz & Smith, PC

(57) ABSTRACT

A vehicle operator signaling system includes a pair of units with each having a control circuit and a transceiver coupled to the control circuit. A plurality of emitters is coupled to the control circuit. A plurality of actuators is coupled to the control circuit and each is associated with one of the emitters. The transceiver of one of the housings emits a distinct signal associated with an actuated one of the actuators and the transceiver of the one of the housings turns on the emitter associated with the distinct signal.

16 Claims, 8 Drawing Sheets

VEHICLE OPERATOR SIGNALING SYSTEM

REFERENCE TO RELATED APPLICATIONS

This application is a continuation in part of U.S. patent application Ser. No. 13/233,218 filed Sep. 15, 2011, which is hereby incorporated by reference in its entirety.

BACKGROUND

1. Field

The disclosure relates to inter-vehicle distress indication systems and more particularly pertains to a new vehicle operator signaling system for allowing signals between riders of multiple vehicles to facilitate communication between the riders when the vehicles become separated by distances that make audible or visual communication difficult.

2. Summary

An embodiment of the disclosure meets the needs presented above by generally comprising a pair of housings. Each of the housings includes a control circuit and a transceiver for transmitting and receiving radio signals is electrically coupled to the control circuit. A plurality of light emitters is electrically coupled to the control circuit. A plurality of actuators is electrically coupled to the control circuit and each is associated with one of the light emitters such that one of the light emitters is turned on when its associated one of the actuators is actuated. The transceiver of one of the housings emits a distinct radio signal associated with an actuated one of the actuators and the transceiver of the one of the housings turns on the light emitter associated with the distinct radio signal. An effective transmission distance of radio signals between the housings is less than 350 m such that the transceiver in one of the housings loses radio signals from the transceiver in another one of the housings after the effective transmission distance has been exceeded to cause the light emitters associated with lost ones of the radio signals to turn off.

The present disclosure relates to a system for signaling between operators of vehicles, and may comprise at least two units configured for communication therebetween. Each of the units may comprise a housing, a control circuit mounted on the housing, and a transceiver configured for transmitting and receiving signals between the units, with the transceiver being communicatively coupled to the control circuit. The system may also comprise a plurality of emitters each being connected to the control circuit, with the emitters being mounted on the housing and including at least a first emitter and a second emitter. The system may also comprise a plurality of actuators each being connected to the control circuit with each of the actuators being associated with one of the emitters such that the associated one of the emitters is turned on when an actuator is actuated and the plurality of actuators comprises at least a first actuator and a second actuator. The control circuit may be configured to cause the transceiver to transmit a first signal when the first actuator is actuated and transmit a second signal when the second actuator is actuated. The control circuit may be configured to turn on the first emitter when the first signal is received and turn on the second emitter when the second signal is received. The control circuit and the transceiver may be configured to retransmit signals received from another unit to other units to extend an effective transmission range of the another unit.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
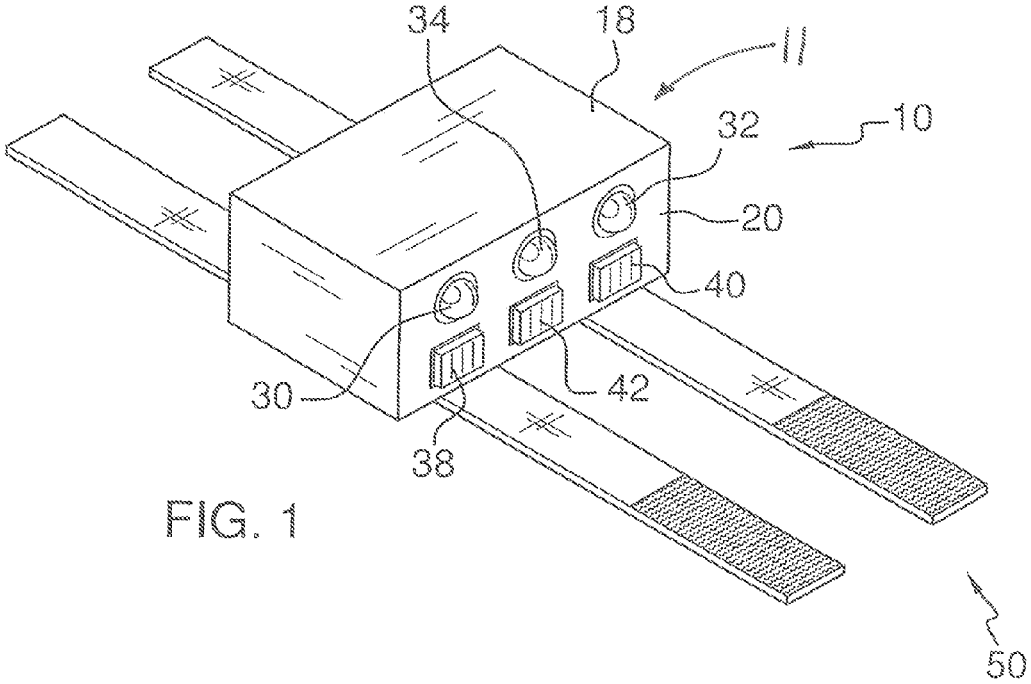
FIG. 1 is a top perspective view of a vehicle operator distress signaling system according to an embodiment of the disclosure.
Figure 2:
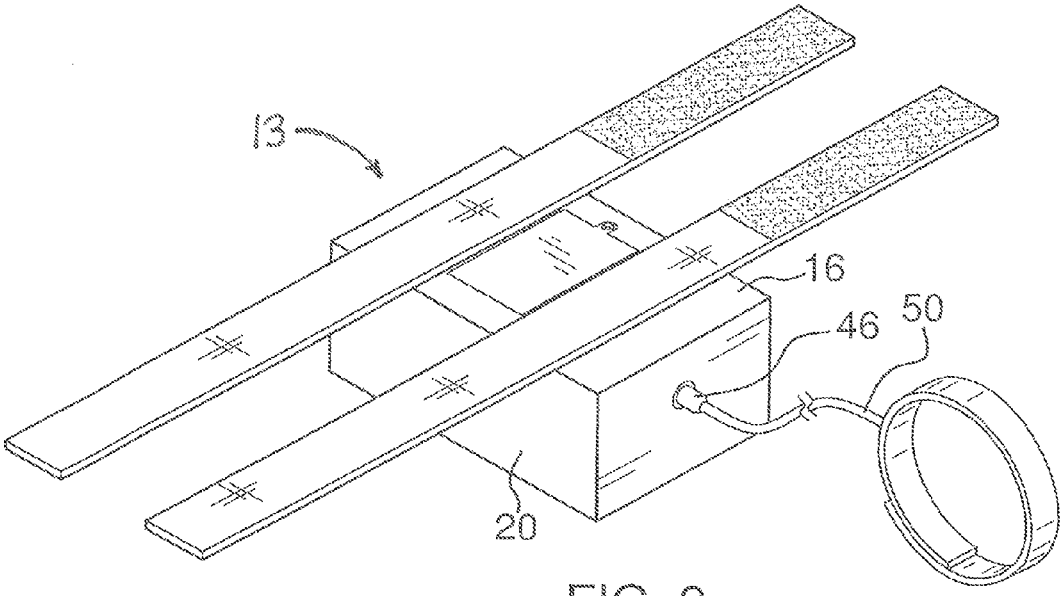
FIG. 2 is a bottom perspective view of an embodiment of the disclosure.
Figure 3:
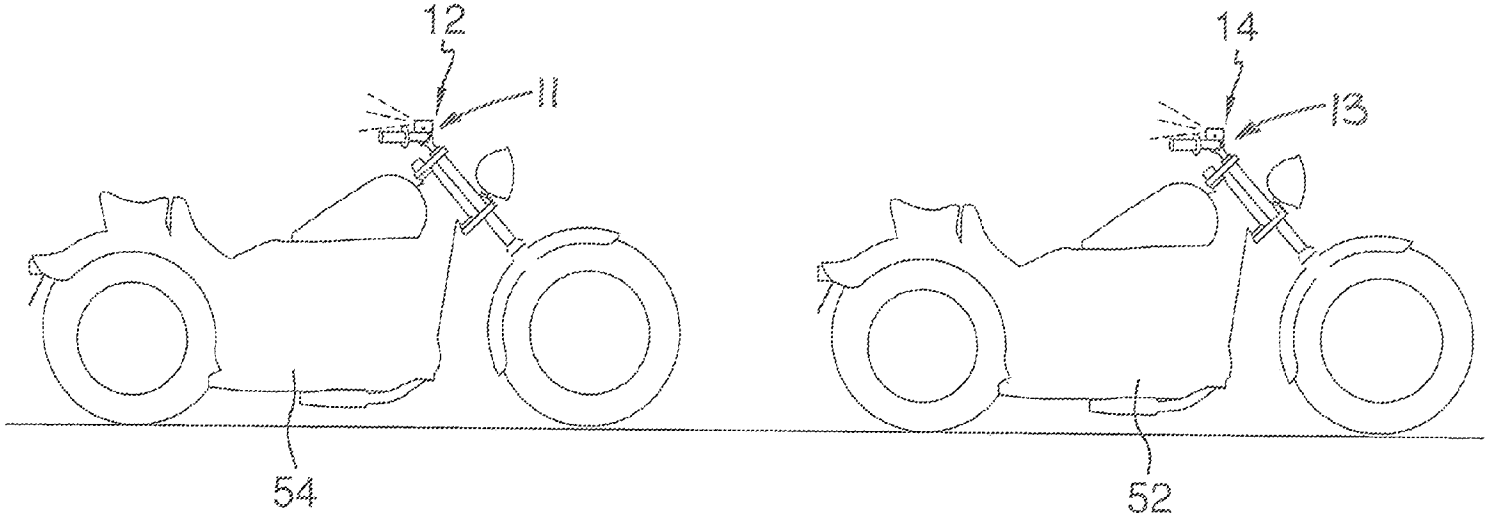
FIG. 3 is an in-use view of an embodiment of the disclosure.
Figure 4:
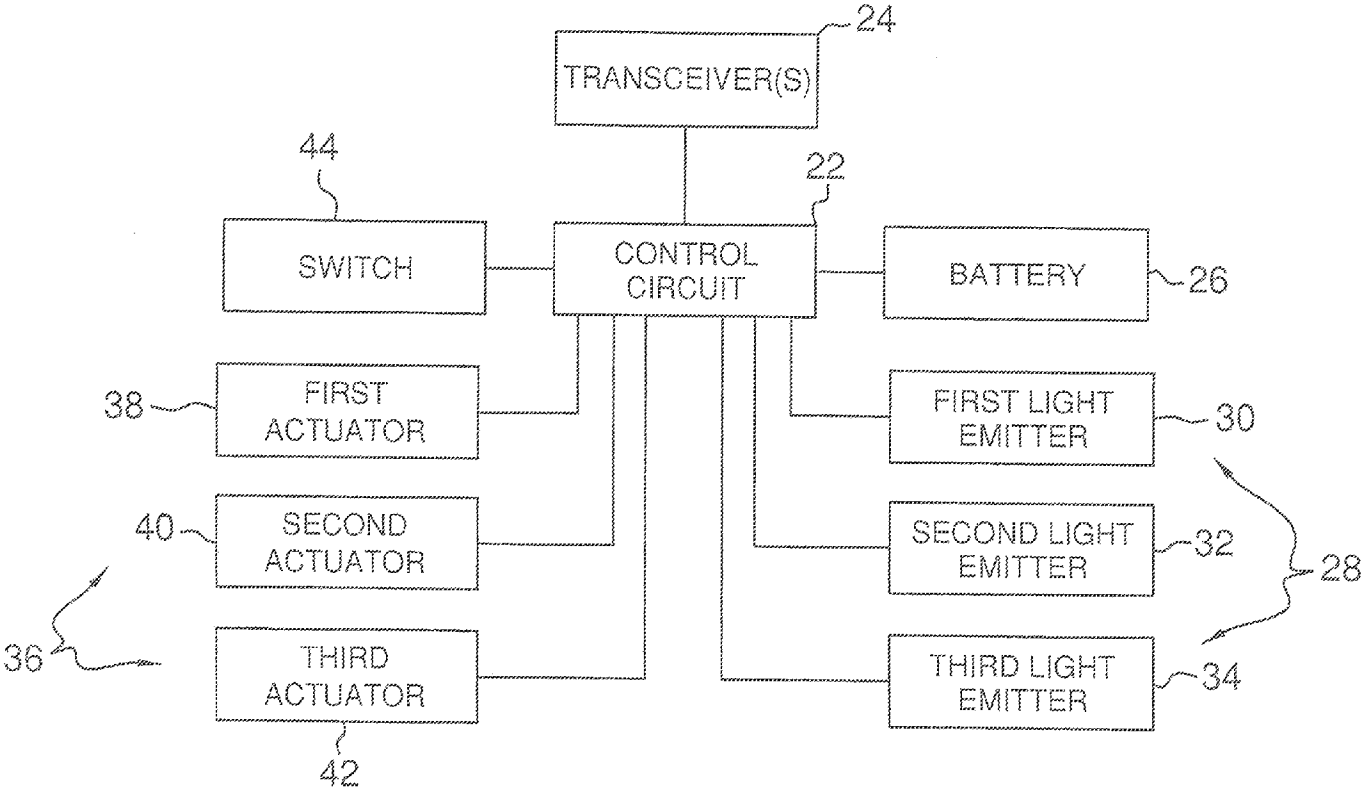
FIG. 4 is a schematic view of an embodiment of the disclosure.
Figure 5:
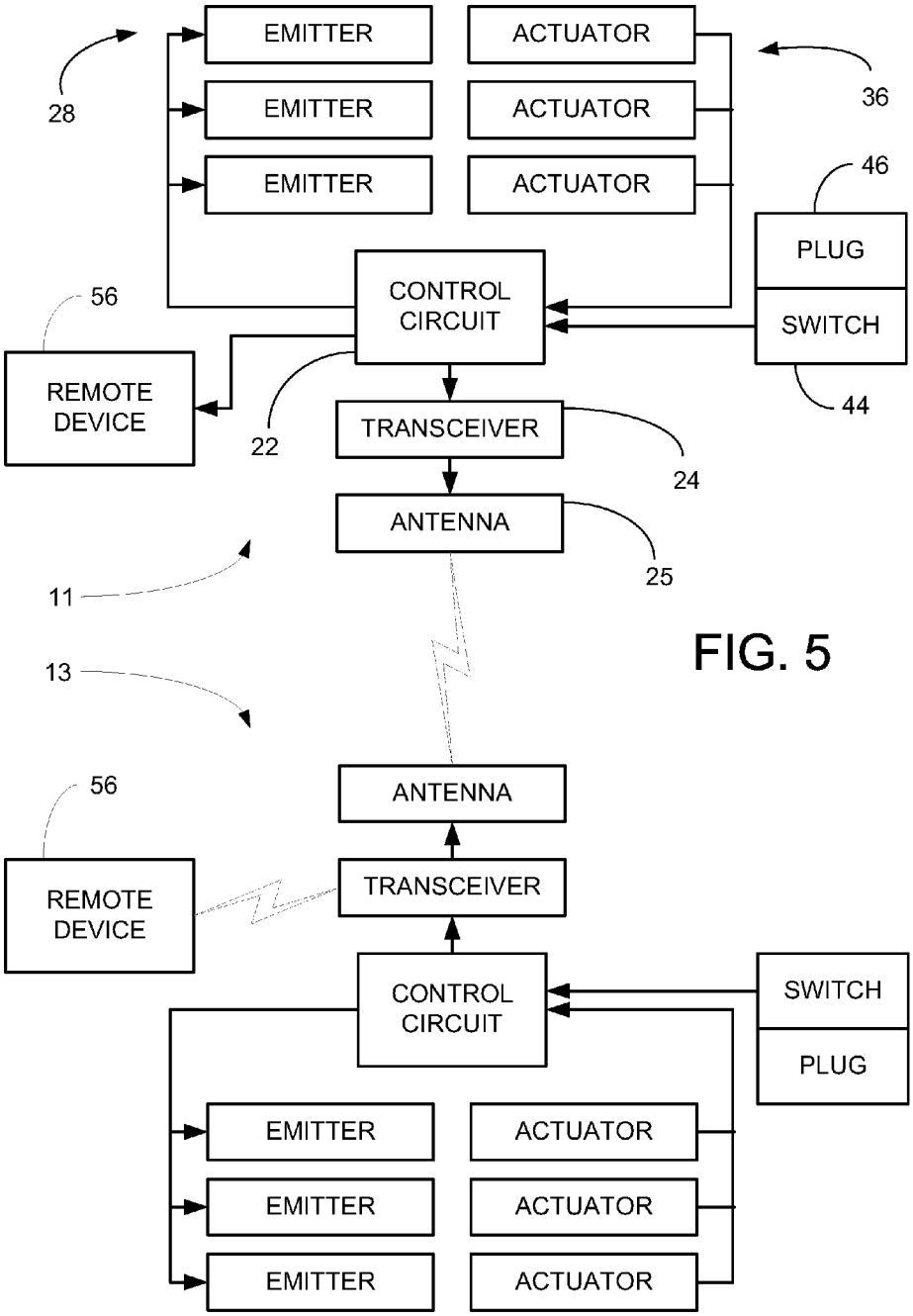
FIG. 5 is a schematic diagram on another embodiment of the elements of the system.
Figure 6:
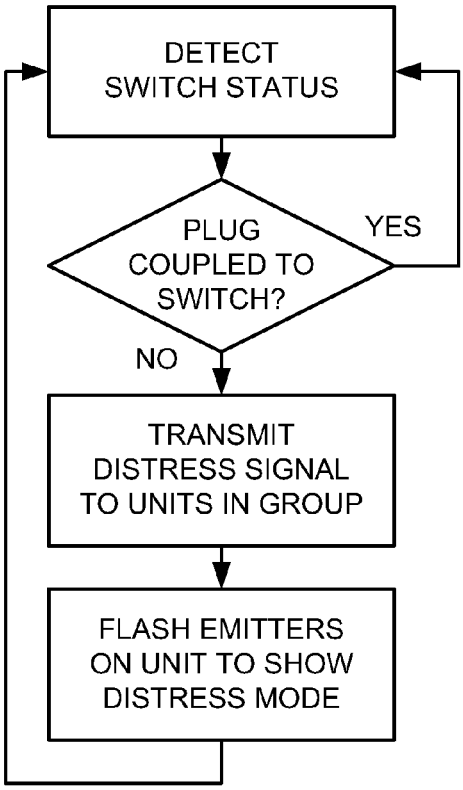
FIG. 6 is a schematic flow diagram of one aspect of the operation of a unit of the system, and illustrates operation relating to the transmission of a distress signal by a unit.
Figure 7:
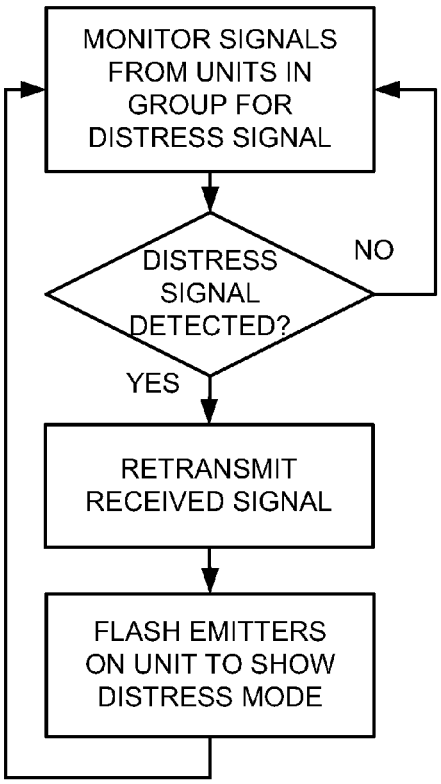
FIG. 7 is a schematic flow diagram of another aspect of the operation of a unit of the system, and illustrates operation relating to reception of a distress signal by a unit.
Figure 8:
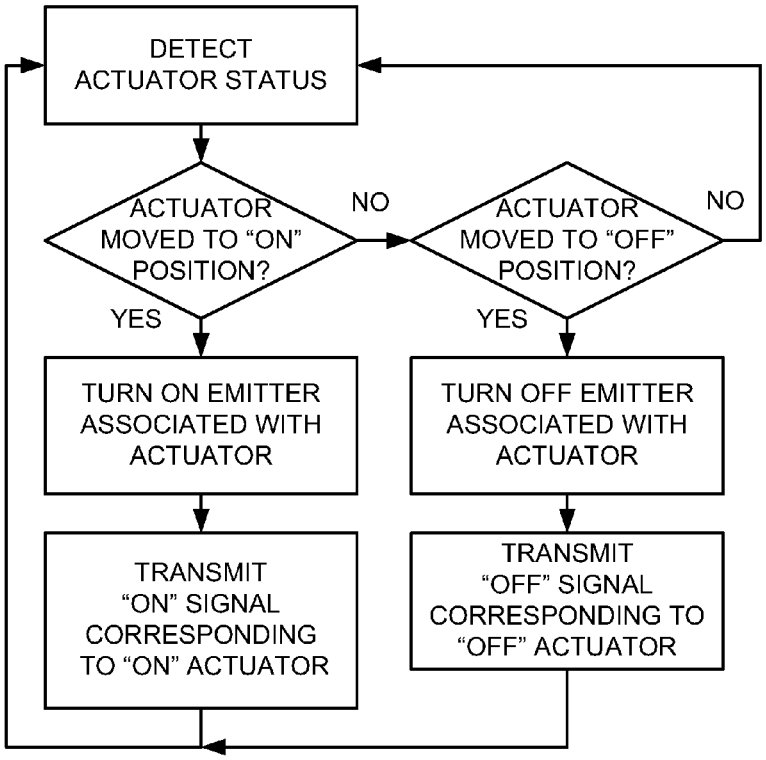
FIG. 8 is a schematic flow diagram of another aspect of the operation of a unit of the system, and illustrates operation relating to transmission of a signal by a unit.
Figure 9:
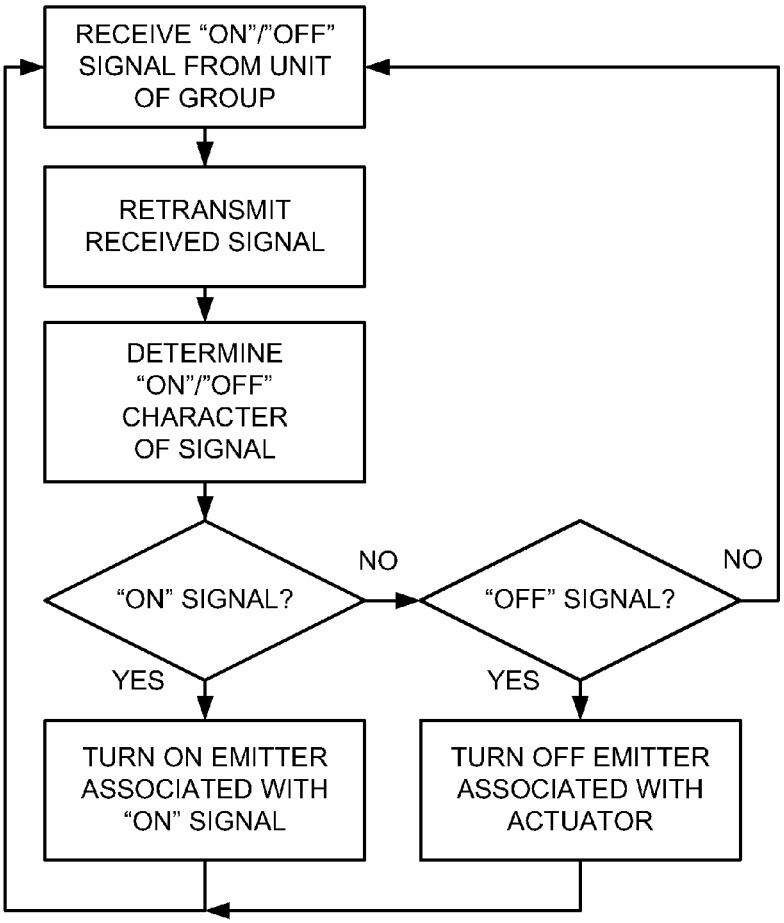
FIG. 9 is a schematic flow diagram of another aspect of the operation of a unit of the system, and illustrates operation relating to reception of a signal by a unit.

With reference now to the drawings, and in particular to FIGS. 1 through 9 thereof, a new vehicle operator signaling system embodying the principles and concepts of the disclosed subject matter will be described.

As best illustrated in FIGS. 1 through 4, the vehicle operator signaling system 10 generally comprises at least a pair of units 11, 13, although three or more units may be employed. Each of the units may be associated with an operator or rider of a vehicle such as a motorcycle, snowmobile, all terrain vehicle (ATV), personal watercraft or virtually any other vehicle. For the purposes of this description, a pair of the units 11, 13 will be described with the understanding that additional units with similar structure and functionality may be utilized. Each unit 11, 13 of the pair of units is preferably, although not necessarily, self-contained in a housing such that a pair of housings 12, 14 may be employed. The housings 12, 14 may have any suitable shape and may include, for instance, a bottom wall 16, a top wall 18 and a perimeter wall 20 being attached to and extending between the top 18 and bottom 16 walls.

Each of the units 11, 13 may include a control circuit 22 and may further include a transceiver 24 for wirelessly transmitting and receiving signals, such as signals transmitted by radio frequency wave. The transceiver 24 is electrically coupled to the control circuit 22. It should be understood that the transceiver 24 may be comprised of a plurality of transceivers and/or a plurality of receivers and a plurality of transmitters and that essentially the system 10 is capable of sending and receiving multiple, distinct signals, and one suitable manner of transmitting distinct signals is to transmit the distinct signals on different radio frequencies, although it should be recognized that a common radio frequency may be utilized for more than one or all of the signals with the signals being distinguished by the content of the signal. An antenna 25 may also be provided with or as a part of the transceiver 24. Each of the units 11, 13 may further include a power supply 26, such as a disposable or rechargeable battery, which is electrically coupled to the control circuit 22.

Each of the units 11, 13 that are to be used together within a functional group of units (with each employed on or with separate vehicles) may be programmed with a common identification (ID) that may be transmitted and received with a signal so that the units may discriminate between signals originating from other units in the same group that should be acted upon, and signals from units in other groups that can essentially be ignored.

Each unit 11, 13 may further include a plurality of emitters capable of emitting a visually perceptible alert, although emitters that emit or generate audible or tactilely perceptible signals, such as sounds or vibrations, may be employed. In the illustrative embodiments, the plurality of visually perceptible emitters comprises a plurality of light emitters 28. The light emitters 28 are each is electrically coupled to the control circuit 22 and may be mounted on the respective housing 12, 14 in a manner that is visible from the exterior of the housing. The plurality of light emitters 28 may include a first light emitter 30 and a second light emitter 32. The plurality of light emitters 28 may further include third 34, fourth, fifth and sixth light emitters, although for the purposes of this description of the illustrative embodiments, three light emitters 28 will be described. The light emitters 28 may be configured so that the emitters may be visually differentiated from each other by the operator, and illustratively each emitter may have a different color with respect to each other. Illustratively, the first light emitter 30 may be green in color, the second light emitter 32 may be red in color, and the third light emitter 34 may be yellow in color. In other illustrative implementations, the colors of the emitters may be red, blue and green. Typically, the meaning or significance of illumination of each individual emitter is not fixed and the operators of the vehicles may agree prior to beginning a ride as to the meaning of illuminating one or more of the lights by one or more of the operators. The light emitters 28 may each comprise light emitting diodes though light bulbs or other light emitting assemblies may also be utilized.

Each of the units 11, 13 may also include a plurality of actuators 36 which are each electrically coupled to the control circuit 22. The actuators 36 may be mounted on the respective housing 12, 14 in a manner that permits the actuator to be actuated by the finger of the operator. In some embodiments, the actuators may be of the momentary contact type, although toggle type actuators may be employed. The actuators 36 may each be associated with one of the light emitters 28 and may control the state of the associated emitters such that one of the light emitters 28 is turned on or off when it's associated one of the actuators 36 is actuated. In the illustrative embodiments, the actuators 36 may include a first actuator 38 associated with the first light emitter 30, a second actuator 40 associated with the second light emitter 32, and a third actuator 42 associated with the third light emitter 34 (and so on if more than three emitters are employed). A one-to-one correspondence between the emitters and the actuators is not necessarily required. Each of the actuators 36 will typically be physically located adjacent to the associated one of the light emitters 28 on the housing. Also, indicia, not shown, may be printed on the housings 12, 14 adjacent to the light emitters 28 or actuators 36 to assist a person in determining the message intended to be conveyed by actuation of a particular one of the actuators 36. Such indicia may be positioned so that it is apparent to a user of the system as to the meaning of an illuminated one of the light emitters.

Illustratively, the transceiver 24 may emit a first signal when the first actuator 38 is actuated, a second signal when the second actuator 40 is actuated, and a third signal when the third actuator 42 is actuated. Additional signals would be available should additional actuator 36/light emitter 28 combinations be added to the system as described above. The control circuit 22 of one of the units may turn on the first light emitter 30 on the same unit when the first signal is received from the other unit or units, the control circuit 22 of the unit may turn on the second light emitter 32 on the same unit when the second signal is received from another unit, and the control circuit 22 of the unit may turn on the third light emitter 34 on the same unit when the third signal is received from another unit. As should be understood, additional light emitters 28 would be turned on as additional signals are received.

It should further be understood that in some embodiments, such as the illustrative embodiments, a distinct radio signal is associated with each corresponding set of associated ones of the actuators 36 and light emitters 28. Thus, if a first actuator 38 of one housing is actuated the transceiver 24 of the unit broadcasts the first signal, and other units receiving the first signal will illuminate the first light emitter 38 while that first signal is being received by the unit. In this manner, each actuator 36 and its associated light emitter 28 may be in a transmitting mode or a receiving mode. Actuating the actuators 36 to an engaged position or condition may cause the unit to assume the transmitting mode while further actuating the actuators to a disengaged position or condition may cause the unit to assume the receiving mode. However, the transmitting and receiving modes are not mutually exclusive as will be further described below.

The units 11, 13 may each include a switch 44 that is mounted on the respective housing 12, 14 and is electrically coupled to the control circuit 22. A plug 46 is mechanically coupled to the switch 44 and the switch 44 is actuated when the plug 46 is removed from the switch 44. Optionally, rather than a mechanical coupling, the plug 46 may be magnetically connected to the switch 44 such that the switch is actuated when the plug is removed from the proximity of the switch. In some of the most preferred embodiments, detection of removal of the plug 46 from the switch 44 by the control circuit will trigger the control circuit to cause the transceiver to transmit a specific signal, such as a distress signal, to the other units of the functional group of units. The control circuitry may also cause other actions by the unit on which the plug has been de-coupled, such as, for example, causing two or more of the emitters on the unit to flash, or alternately illuminate and de-illuminate. Reception of the distress signal by another unit of the functional group may trigger the control circuitry on those units to cause similar actions in the receiving units, such as flashing of the emitters, etc.

In other implementations, the removal or de-coupling of the plug 46 from the switch 44 may cause the control circuit 22 to prevent transmitting of the first signal when the switch 44 is actuated and/or the transceiver 24 may transmit the second signal when the switch 44 is actuated. Thus, if a first unit 11 is transmitting the first signal, the first light emitter 30 will be illuminated on both the first unit 12 and a second unit 13 in radio communication with the first unit 11. However, if the switch 44 of the first unit 11 is actuated, the first light emitter 30 will turn off on the second unit 13 to indicate to the person viewing the second unit 13 that some sort of distress may have occurred with respect to the operator of the first unit 11. This may further be emphasized if the second signal is sent to cause the second light emitter 42 on the second unit 13 to be illuminated.

In operation, the plug 46 may be attached to a tether 48 to wear around a portion of the person's body, such as an arm or leg. Thus, if a person or operator, for instance, falls from a vehicle having the first unit 11 thereon, an indication (such as the distress signal) will be sent by the first unit 11 to the other units of the functional group, such as the second unit 13, without the operator associated with the first unit having to actuate one of the actuators on the unit, and the operator of the vehicle with the second unit is notified of potential trouble encountered by the operation of the vehicle associated with the first unit. The indication may comprise, for example, the aforementioned illumination and flashing of two or more of the emitters on all other units, or as another example, the second light 42 on the second housing 14 will be illuminated as long as the two units 11, 13 are within receiving range of each other. The units may be restored to normal operation by, for example, re-coupling the plug 46 with the switch 44.

An effective, or generally specific, signal reception distance may exist between the housings 12, 14 of the units 11, 13. Thus, in some embodiments, the units may be configured to operate so that when two vehicles (each having one of the units 11, 13) become separated by a distance substantially exceeding a maximum effective transmission or reception distance, the light emitters 28 which are turned on when receiving radio signals from the other units, may turn off to indicate to the operator of one vehicle (such as the lead vehicle) that the transmitting vehicle has fallen behind a distance which exceeds the signal reception distance, and may be unacceptable for retaining the vehicles in a convoy type grouping. The effective transmission distance of radio signals between the housings 12, 14 of the units may be less than about 350 m, or less than about 1150 feet, such that the transceiver 24 in one of the units 11, 13 is unable to receive signals transmitted from the transceiver 24 in another one of the units 11, 13 when the effective transmission distance has been exceeded to cause the light emitters 28 associated with lost ones of the radio signals to turn off.

Due to the transmission/reception range limitations of compact transmitter hardware and government licensing restrictions, the maximum effective transmission distance may be shorter than desired by some users or for some applications of the system. As an example, when several vehicles are being used in a convoy-like manner assembly, while the separation distance between adjacent vehicles in the convoy may not be that great, the distance between the lead vehicle from the last vehicle in the group may exceed the maximum effective transmission distance and this may interfere with communication between all units of the group of vehicles should the separation distance become too great. Significantly, in some embodiments of the system the transceiver of at least one and preferably all of the units is capable of receiving and retransmitting a signal transmitted from another one of the units of the system. Thus, a signal transmitted by the unit on a lead vehicle in an array of vehicles may be received by another unit on a second vehicle in the array and may be retransmitted by the another unit, and this may be repeated by units on subsequent vehicles in the array. In this way, the signal may reach the last vehicle in the array of vehicles even if the distance from the front of the array of vehicles to the rear of the array of vehicles is greater than the maximum transmission distance. The retransmission of a received signal by a unit can also serve to confirm to the unit originally transmitting the signal that the signal has actually been received by at least one other unit in the functional group, and one of the emitters may be flashed on the originally transmitting unit to provide the operator that the signal has been received.

Each of the units 11, 13 may be provided with a coupler 50 such that each of the respective housings 12, 14 has one of the couplers 50 attached thereto. The couplers 50 attach the housings 12, 14 to objects forming a part of a vehicle, to allow use of one of the units with the vehicle to permit radio signaling between the objects. As illustratively shown in FIG. 1, the couplers 50 may include straps having hook and loop connectors thereon to allow the straps, for instance, to be wrapped around and secured to handlebars of a motorcycle, snowmobile, all terrain vehicle, bicycle or the like. Alternate couplers 50 may be used as required depending on type of vehicle to be used as well as placement opportunities. Thus the couplers 50 may comprise magnets, brackets, fasteners (threaded screws/bolts and the like), or other conventional coupling means. The advantage of the straps would be that it would allow easy retrofitting to vehicles having handlebars without requiring marring of drilling into the vehicle in question.

In some embodiments, a remote device 56 may be used with the system 10 but has limited functionality as compared to one of the units. For example, the remote device 56 may provide display functionality with emitters that may be easier to perceive by the operator. For example, the remote device 56 may be linked to one of the units through wired or wireless means, and since the remote device may lack the transceiver circuitry and functionality, as well as other control functionality, the remote device can be of significantly smaller dimension. Due to the limited functionality, the device 56 may be compact enough to be mounted, for example, on the visor of the user's helmet, cap or other garment or even on the sunglasses or other eye protection device, In other embodiments, the remote device 56 may comprise a physically larger device that is connectable or linkable with one of the units to provide a more visible presence, such as a stoplight or traffic light object that may be placed adjacent to or even on a street to provide selectively illuminable lights that correspond to the emitters on the associated unit.

In use, the system 10 has the advantage of providing a visual indicator between two or more personal vehicles with respect to information (e.g., problems) associated with the operation of the vehicles or persons operating them. Below are example scenarios for usage of the system 10 wherein the system 10 is used by a group of motorcycle riders utilizing a functional group of the units of the system. If the group includes two or more, and for example five, motorcycles, at least two units will be used so that the front rider, or motorcycle 52, has a unit 13 and the rear rider, or motorcycle 54, also has a unit 11. Illustrative scenarios include:

1) The rear rider 54 will actuate the first actuator 38 on the unit 11 to send out the first signal to the unit 13 of the front rider 52. This will cause the first light emitter 30 (green) of the front rider's unit 13 to turn on to indicate a predetermined or agreed upon message, such as "go" or "continue," and may indicate that the rear rider 54 is within a suitable distance of the front rider 52 and that there are no problems with any intermediate riders between the front 52 and rear 54 riders. The units may periodically "ping" the other unit to indicate that the units remain within the effective transmission distance of each other, and this ping may be indicated by a periodic flashing of the first emitter to let the user of the unit that the other unit is in communication with the user's unit.

2) Should the rear rider 54 fall back too far in the array of motorcycles, the effective radio transmission distance limitation may cause the front rider 52 to lose reception of the signal from the unit 11 of the rear motorcycle, such as the "ping" signal, which may cause the first light emitter 30 on the front rider's unit 13 not to flash. The front rider 52 may then choose to slow down until the rear rider catches up to a degree that the signal is again received, and may further come to a stop if the signal is not again received so that the front rider 52 can turn around and determine if assistance is needed. In other implementations, such as those where additional units are employed and the units are configuration to act as repeaters of the transmissions from the units, the communication distance between the front motorcycle and the rear motorcycle is not limited to the effective transmission distance of any one unit, as the intermediate units on motorcycles between the front and rear motorcycles link the units in a daisy chain fashion. Thus, the communication linkage between all units may not be interrupted unless and until a distance between a unit and the next closest units exceeds the maximum effective transmission distance.

3) Should the rear rider 54 experience immediate difficulties such as a flat tire or engine problems, or view such an event happening to an intermediate rider, the rear rider 54 can actuate the second actuator 40 causing the second light emitters 32 of the units of the front 52 and rear 54 riders to be turned on, whose agreed upon meaning may be to "stop." This may signal to the front rider 52 to stop immediately and other intermediate riders may follow the front rider's 52 lead.

4) Should the rear rider 54, an intermediate rider, or the front rider 52 desire to stop in the near but not immediate future, the rider may actuate the third actuator 42 on the rider's unit causing the third light emitters 34 of the units of the functional group to be turned on, which may have an agreed upon meaning of "stop at earliest convenience" or something similar. The front rider 52 may then stop at the next convenient spot to do so.

5) In embodiments in which more than two units 11, 13 are employed, one or all of the intermediate riders may also have a unit on their motorcycles. These units, or intermediate units, may be used primarily to receive signals and only be used for transmitting the signals or may have full functionality to originate signals.

While the above includes an example of usage between motorcycles, it may be used with any number of personal vehicles as described above. It may also be used where communication between persons is very difficult such as while operating heavy machinery. Other uses could include signals between skiers, hikers, or other sporting activities where distances between the participants may be dangerous due to a lead person not being aware of a problems being experienced by those in the rear.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A system for signaling between operators of vehicles, comprising:

at least two units configured for communication therebetween, each of the units comprising:

a housing;

a control circuit mounted on the housing;

a transceiver configured for transmitting and receiving signals between the units, said transceiver being communicatively coupled to the control circuit;

a plurality of emitters each being connected to the control circuit, the emitters being mounted on the housing, the plurality of emitters including at least a first emitter and a second emitter;

a plurality of actuators each being connected to the control circuit, each of the actuators being associated with one of the emitters such that the associated one of the emitters is turned on when an actuator is actuated, the plurality of actuators comprises at least a first actuator and a second actuator;

wherein the control circuit is configured to cause the transceiver to transmit a first signal when the first actuator is actuated, the control circuit being configured to cause the transceiver to transmit a second signal when the second actuator is actuated, the control circuit being configured to turn on the first emitter when the first signal is received, the control circuit turning on the second emitter when the second signal is received; and wherein the control circuit and the transceiver are configured to retransmit signals received from another unit to other units to extend an effective transmission range of the another unit.

2. The system of claim 1 wherein each of the units further comprise a switch connected to the control circuit, the switch being mounted on the housing; and a plug being removably coupled to the switch, the switch being actuated when the plug is decoupled from the switch, the control circuit being configured to cause the transceiver to transmit a distress signal to other units which causes the control circuits of the other units to turn on the emitters on the other units.

3. The system of claim 2 wherein the control circuits of the other units are configured to flash the emitters when the distress signal is received.

4. The system of claim 2 wherein the control circuits of the other units are configured to turn on all of the emitters when the distress signal is received.

5. The system of claim 2 wherein each of the units further comprises a tether coupled to the plug and configured to be attached to a body portion of the operator.

6. The system of claim 2 wherein the control circuit and the transceiver are generally contained in the housing, the actuators being mounted on the housing with each of the actuators being located physically proximate to the associated emitter on the housing.

7. The system of claim 1 additionally comprising a remote device separate of the housing of the unit and being communicatively connectable to the control circuit of the unit, the remote device having at least one emitter corresponding to one of the emitters on the housing such that the emitter on the remote device is turned on with the emitter on the housing.

8. The system of claim 1 wherein the control circuit of a first one of the units is configured to turn on one of the emitters when the transceiver of the first unit detects that a second one of the units has retransmitted a signal originating from the first unit to confirm to an operator of the first unit that the second unit received the signal.

9. The system of claim 1 wherein each of the units emit a signal to other said units on a predetermined periodic basis without operator actuation of an actuator, the signal causing the other units to flash one of the emitters to indicate proximity of the units within a transmission and reception range of the transceivers of the units.

10. The system of claim 9 wherein the control circuits of the units are configured to flash the light emitters when the distress signal is received;

wherein each of the units further comprises a tether coupled to the plug and configured to be attached to a body portion of the operator;

a remote device separate of the housing of the unit and being communicatively connectable to the control circuit of the unit, the remote device having at least one emitter corresponding to one of the emitters on the housing such that the emitter on the remote device is turned on with the emitter on the housing;

wherein the control circuit and the transceiver are generally contained in the housing, the actuator switches being mounted on the housing with each of the actuator switches being located physically proximate to the associated light emitter on the housing;

wherein the plug is magnetically connected to the switch;

wherein the control circuit causes flashing of two or more of the light emitters on the unit on which the plug has been de-coupled from the switch;

wherein the control circuit of a first one of the units is configured to turn on one of the emitters when the transceiver of the first unit detects that a second one of the units has retransmitted a signal originating from the first unit to confirm to an operator of the first unit that the second unit received the signal; and wherein each of the units emit a signal to other said units on a predetermined periodic basis without operator actuation of an actuator switch, the signal causing the other units to flash one of the light emitters to indicate proximity of the units within a transmission and reception range of the transceivers of the units.

11. A system for signaling between operators of vehicles, comprising:

at least two units configured for communication therebetween, each of the units comprising:

a housing;

a control circuit mounted on the housing;

a transceiver configured for transmitting and receiving signals between the units, said transceiver being communicatively coupled to the control circuit;

a plurality of emitters each being connected to the control circuit, the emitters being mounted on the housing, the plurality of emitters including at least a first emitter and a second emitter;

a plurality of actuators each being connected to the control circuit, each of the actuators being associated with one of the emitters such that the associated one of the emitters is turned on when an actuator is actuated, the plurality of actuators comprises at least a first actuator and a second actuator;

a switch connected to the control circuit, the switch being mounted on the housing; and a plug being removably coupled to the switch, the switch being actuated when the plug is decoupled from the switch, the control circuit being configured to cause the transceiver to transmit a distress signal to other units which causes the control circuits of the other units to turn on the emitters on the other units; and wherein the control circuit and the transceiver of each of the units are configured to retransmit signals received from another unit to other units to extend an effective transmission range of each of the units beyond a maximum transmission distance of the unit.

12. The system of claim 11 wherein the control circuit is configured to cause the transceiver to transmit a first signal when the first actuator is actuated and transmit a second signal when the second actuator is actuated.

13. The system of claim 12 wherein the control circuit is configured to turn on the first emitter when the first signal is received, the control circuit turning on the second emitter when the second signal is received.

14. The system of claim 11 wherein the plug is magnetically connected to the switch.

15. The system of claim 11 wherein the control circuit causes flashing of two or more of the emitters on the unit on which the plug has been de-coupled from the switch.

16. A system for signaling between operators of vehicles, comprising:

at least a first unit and a second unit, the units being physically independent such that the units are movable to locations remote from each other, each of the units comprising:

a housing;

a control circuit mounted on the housing;

a transceiver configured for wirelessly transmitting and receiving signals between the units, said transceiver being communicatively coupled to the control circuit;

at least a first indicator set and a second indicator set, each indicator set being mounted on the housing and being connected to the control circuit, each of the indicator sets including a light emitter and an actuator switch, the light emitter of a said indicator set being illuminated when the actuator of the same said indicator set is actuated by a user associated with the unit;

wherein the control circuit is configured such that actuation of the actuator switch of the first indicator set by a user associated with a said unit causes illumination of the light emitter of the first indicator set of the unit and the transceiver of the unit transmits a first signal that when received by another said unit causes the control circuit of the another unit to illuminate the light emitter of the first indicator set of the another unit such that actuation of the actuator switch on one unit causes illumination of the light emitter of the first indicator set on the unit and the another unit; and wherein the control circuit is configured such that actuation of the actuator switch of the second indicator set by a user associated with the unit causes illumination of the light emitter of the second indicator set of the unit and the transceiver of the unit transmits a second signal that when received by the another unit causes the control circuit of the another unit to illuminate the light emitter of the second indicator set of the another unit such that actuation of the actuator switch on one unit causes illumination of the light emitter of the second indicator set on the unit and the another unit;

a switch mounted on the housing and connected to the control circuit; and a plug being removably coupled to the switch, the switch being actuated when the plug is decoupled from the switch, the control circuit being configured to cause the transceiver to transmit a distress signal, said distress signal when received by one of the units causing the control circuit of the unit to illuminate each of the light emitters on the unit; and wherein the control circuit and the transceiver of each unit is configured to retransmit signals received from another unit to other units to extend an effective transmission range of each of the units beyond a maximum transmission distance of the unit.

* * * * *